US006392343B1

(12) United States Patent
Luijks et al.

(10) Patent No.: US 6,392,343 B1
(45) Date of Patent: May 21, 2002

(54) METAL HALIDE LAMP

(75) Inventors: Gerardus Marinus Josephus Franciscus Luijks; Martinus Joseph Maria Kessels, both of Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 127 days.

(21) Appl. No.: 09/593,838

(22) Filed: Jun. 14, 2000

(30) Foreign Application Priority Data

Jun. 16, 1999 (EP) ..... 99201928

(51) Int. Cl.[7] ..... H01J 61/34

(52) U.S. Cl. ..... 313/570; 313/25; 313/634; 315/60; 315/150; 315/289

(58) Field of Search ..... 313/570, 25, 634, 313/595, 596, 601, 643, 623; 315/60, 59, 150, 289, 287, 290

(56) References Cited

U.S. PATENT DOCUMENTS

| | | | | | |
|---|---|---|---|---|---|
| 4,721,888 | A | * | 1/1988 | Proud et al. | 315/60 |
| 4,808,888 | A | * | 2/1989 | Wyner et al. | 315/289 |
| 4,812,714 | A | * | 3/1989 | Keefe et al. | 315/60 |
| 4,818,915 | A | * | 4/1989 | Zaslavsky et al. | 315/60 |
| 4,987,344 | A | | 1/1991 | Zaslavsky et al. | 315/59 |
| 5,563,474 | A | | 10/1996 | Wessels et al. | 315/248 |
| 5,811,933 | A | | 9/1998 | Van Den Nieuwenhuizen et al. | 313/570 |
| 5,990,599 | A | * | 11/1999 | Jackson et al. | 313/25 |

* cited by examiner

*Primary Examiner*—Ashok Patel
(74) *Attorney, Agent, or Firm*—Dicran Halajian

(57) ABSTRACT

The invention relates to a metal halide lamp having an outer bulb containing besides a discharge vessel a UV enhancer (UVE). The UVE has a ceramic wall and, according to the invention, is provided with a pair of internal electrodes. Preferably, at least one of the electrodes has an electrode winding with emitter.

4 Claims, 3 Drawing Sheets

METAL HALIDE LAMP

BACKGROUND OF THE INVENTION

The invention relates to a metal halide lamp provided with a discharge vessel which encloses a discharge space and which is surrounded with intervening space by an outer bulb which is fitted with a lamp cap, in which intervening space a UV enhancer (UVE) with a ceramic wall is accommodated.

A lamp of the kind mentioned in the opening paragraph is known from U.S. Pat. No. 5,811,933. The known lamp, which has a discharge vessel with a ceramic wall, has a high ignition voltage. An installation suitable for operating the known lamp should accordingly be provided with an ignition circuit in addition to a ballast circuit. The UVE in the known lamp is provided with an internal electrode and is capacitively coupled to a current conductor to the discharge vessel. The UVE has a filling of only a rare gas. It is possible with such a UVE to ignite the lamp by means of an ignition pulse of 3 kV with a small ignition delay. A further favorable property of the UVE of the known lamp is its very compact construction. A disadvantage of the known UVE is that it ignites unreliably, or even not at all, at voltages well below 3 kV.

The term "ceramic wall" in the present description and claims is understood to mean a wall of a metal oxide such as, for example, sapphire or densely sintered polycrystalline $Al_2O_3$ (referred to hereinafter as pca) as well as a wall made of metal nitride, for example AlN.

Besides lamps having a high ignition voltage and accordingly requiring a separate ignition circuit which supplies high ignition voltage pulses, there are also metal halide lamps which ignite reliably at a low ignition voltage of at most 600 V. In addition, there are metal halide lamps which are suitable for being ignited and operated directly on a ballast circuit, i.e. which do not require a separate ignition circuit. Said lamps having a low ignition voltage of up to 600 V are usually provided with radioactive ignition means for this purpose, for example in the shape of electrodes provided with a $ThO_2$ pellet. A radioactive Penning mixture is also used as an ignition means in such lamps. The use of radioactive ignition means, however, is disadvantageous. Furthermore, these lamps may be provided with built-in starters, for example in the form of a glowswitch starter.

SUMMARY OF THE INVENTION

The invention has for its object to provide a lamp which ignites reliably at a low ignition voltage and in which the above disadvantages have been eliminated.

According to the invention, a lamp of the kind mentioned in the opening paragraph is characterized in that the UVE is provided with two internal electrodes between which a glow discharge can extend. It was surprisingly found that the use of a UVE provided with two internal electrodes substantially counteracts the occurrence of ignition delays at low ignition voltages and in the absence of radioactive ignition means. In a further advantageous embodiment of the lamp, one of the two internal electrodes is provided with an electrode winding. A further reduction in the ignition delay is achieved thereby. A further improvement can be achieved in that one of the internal electrodes is provided with an emitter. In a further preferred embodiment of the lamp, each of the electrodes of the UVE is provided with an electrode winding with emitter.

A further advantage of the UVE of the lamp according to the invention is that it is also suitable for use in lamps which have a high ignition voltage, for example the known lamp. This is also true in the case in which the UVE has an electrode winding and is provided with emitter. A universally applicable UVE is thus realized, which brings with it the possibility of a substantial simplification in lamp manufacture.

Although UVEs with glass or quartz walls are known per se, it is found that their use in a comparable metal halide lamp leads to unacceptable ignition delay times owing to impurities which are inevitably released from the wall. The ignition delays can only be reduced to practically useful values, it is found, through the use of additional ignition means. A further practical disadvantage of such UVEs is that their dimensions are considerably larger compared with the very compact construction which is possible for a UVE with a ceramic wall.

BRIEF DESCRIPTION OF THE DRAWINGS

The above and further aspects of the invention will be explained in more detail below with reference to a drawing, in which.

DETAILED DESCRIPTION OF THE PREFERRED EMBODIMENTS

Figure 1:
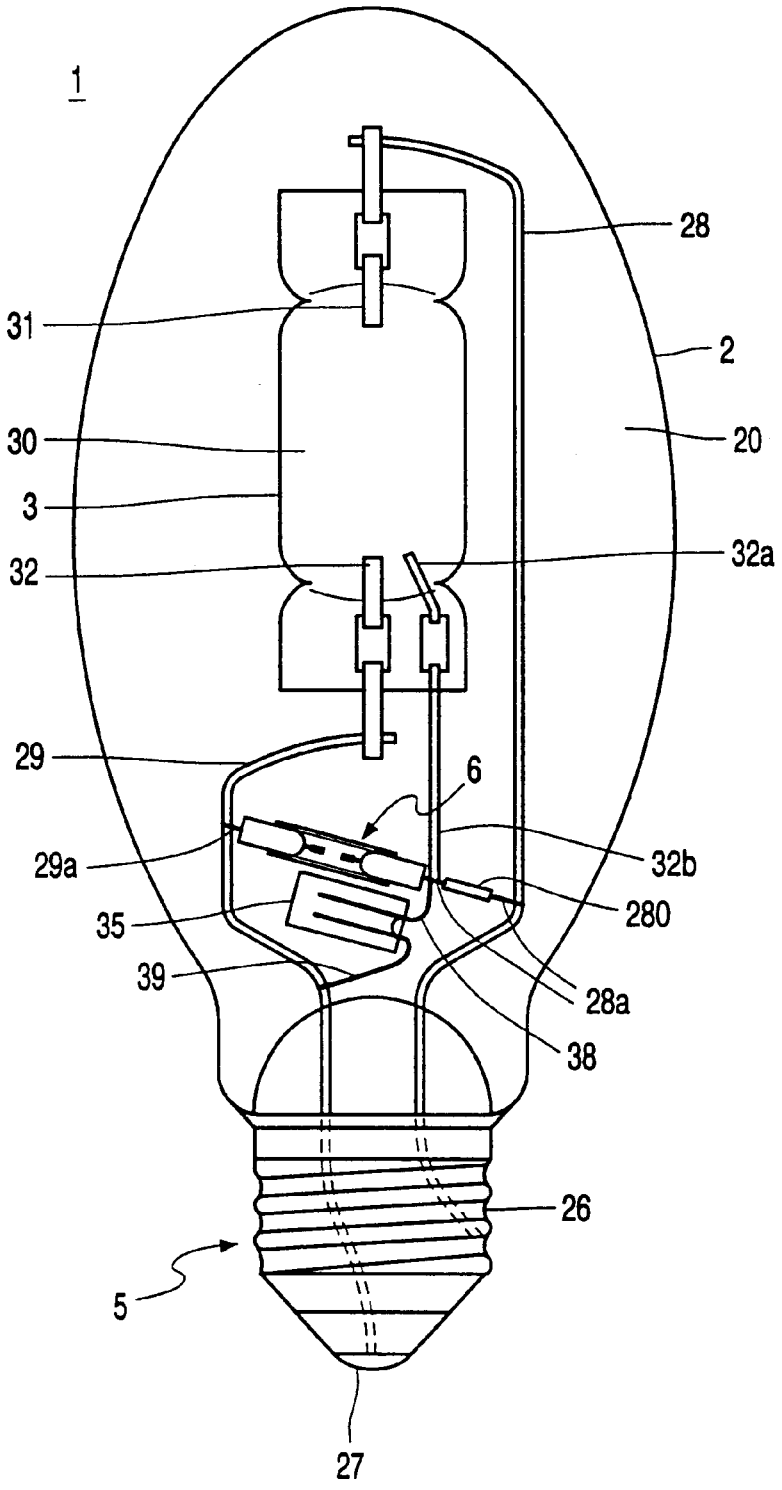
FIG. 1 is an elevation of a lamp according to the invention.

In FIG. 1, a metal halide lamp 1 is provided with a discharge vessel 3 which encloses a discharge space 30 and which is surrounded with an intervening space 20 by an outer bulb 2 which is fitted with a lamp cap 5, in which intervening space 20 a UVE 6 with a ceramic wall is accommodated. The discharge vessel 3 has a wall of hard glass or quartz glass.

The outer bulb 2 is closed off by a lamp cap 5 provided with two connection points 26, 27. The connection point 26 is connected to a main electrode 31 in the discharge space 30 via a current conductor 28. Similarly, the connection point 27 is connected to a main electrode 32 in the discharge vessel via a current conductor 29. The UVE 6 is electrically connected to the current conductor 28 by means of a conductor 28*a* and to the current conductor 29 by means of a conductor 29*a*. A resistor 280 serving as a current limiter for the UVE is included in the conductor 28*a*. The lamp shown is also provided with an auxiliary electrode 32*a*. The auxiliary electrode 32*a* is connected to the conductor 28*a* by means of a conductor 32*b*. The discharge vessel of the lamp is further provided with an internal bimetal switch 35 which is connected to the auxiliary electrode 32*a* via a connection conductor 38 and also to the conductor 28 via the resistor 280. At the other side, a connection conductor 39 of the bimetal switch 35 is connected to the conductor 29. The bimetal switch, which is open in the cold state, will be closed when the lamp is in the ignited state under the influence of the heat generated by the lamp, thus ensuring that no arc discharge between the electrode 32 and the auxiliary electrode 32*a* can take place in the ignited state of the lamp. The resistor 280 here not only serves as a current limiter for the UVE, but also serves to limit a short-circuit current through the bimetal switch when the lamp is in the ignited state. The lamp described is suitable for being ignited and operated on a ballast circuit without a separate ignition circuit.

Figure 2:
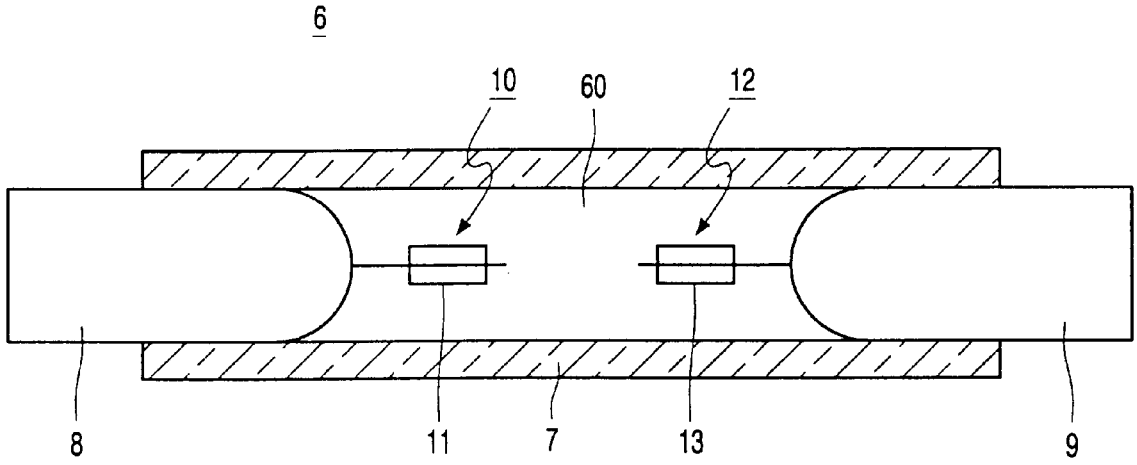
FIG. 2 is a cross-section of a UVE of the lamp of FIG. 1.

In FIG. 2, the UVE 6 of the lamp of FIG. 1 is shown in more detail in cross-section. The UVE has a cylindrical ceramic wall 7 which is closed off at either end by means of a bush-shaped Nb lead-through element 8, 9. The UVE thus encloses a space 60. The UVE is provided with two internal electrodes 10, 12 which are provided with respective electrode windings 11 and 13. The electrode 10 is fastened on the lead-through element 8 with electrical conduction in a manner known per se. The electrode 12 is fastened on the lead-through element 9 in a similar manner. The lead-through elements 8, 9 are externally connected to respective conductors 28*a* and 29*a*. A resistor 280 is included in the conductor 28*a* (FIG. 1), serving as a current limiter for the UVE. A glow discharge can establish itself between the two internal electrodes 10 and 12. The resistance 280 then ensures that the glow discharge arising in the UVE does not change into an arc discharge.

In a practical realization of the lamp described above, the lamp has a rated power of 400 W and is suitable for being ignited and operated on a 220 V, 50 Hz supply source. The lamp has a nominal lamp voltage of 125 V during stable operation. The discharge vessel has an ionizable filling which comprises 81 mg Hg and also 16 mg iodide salts in the following ratio by weight: 84.8% NaI, 11.6% TlI, 2.8% InI, and 0.8% $InI_3$. In addition, the discharge vessel contains a NeAr rare gas mixture in a ratio of 99.5:0.5 at a filling pressure of 50 mbar. The lamp is provided with a UVE with a cylindrical wall made of pca. The lead-through elements are Nb bushes which are connected to the pca in a gastight manner by means of a melting-glass joint. An internal electrode is fastened on each Nb bush and is formed in a manner known per se by a W rod of 700 $\mu$m diameter provided with a double W electrode winding consisting of a coiled W wire with a diameter of 200 $\mu$m. The electrode windings are provided with an emitter, for example $Ba_3Y_2WO_9$ (TBYD). The space enclosed by the UVE is filled with Ar under a filling pressure of 15 mbar. A Penning mixture of Ne with 1% Ar was found to be also suitable as a filling of the UVE.

The UVE has an internal diameter of 3 mm and a distance between the internal electrodes of 3 mm. The UVE has a greatest external length of 30 mm. The UVE has an ignition voltage of 150 V. The ignition voltage of the UVE lies between the fall voltage of the supply source and the lamp voltage during stable lamp operation. As a result, the UVE will ignite at the voltage supplied by the supply source. Once the lamp has ignited, the voltage across the UVE will drop to the lamp voltage level, and the UVE will accordingly no longer reach the conductive state. The resistor 280 has a value of 17 kΩ and thus prevents a glow discharge in the UVE from changing into an arc discharge. Furthermore, the current through the bimetal switch is limited to a few mA during lamp operation.

When the lamp is ignited after it has been stored in the dark for a period of at least 24 hours, breakdown in the UVE takes place with an ignition delay of approximately 20 ms, i.e. less than 1 s, and the lamp ignites with a delay of approximately 1 s, i.e. far below the value of 30 s which has been laid down as the maximum allowable ignition delay. A comparable lamp provided with a comparable UVE whose electrodes are free from emitter, when ignited under similar circumstances, will have an ignition delay in the UVE of approximately 10 s. The lamp in this case will ignite with a similar delay, which accordingly is below 30 s.

Figure 3:
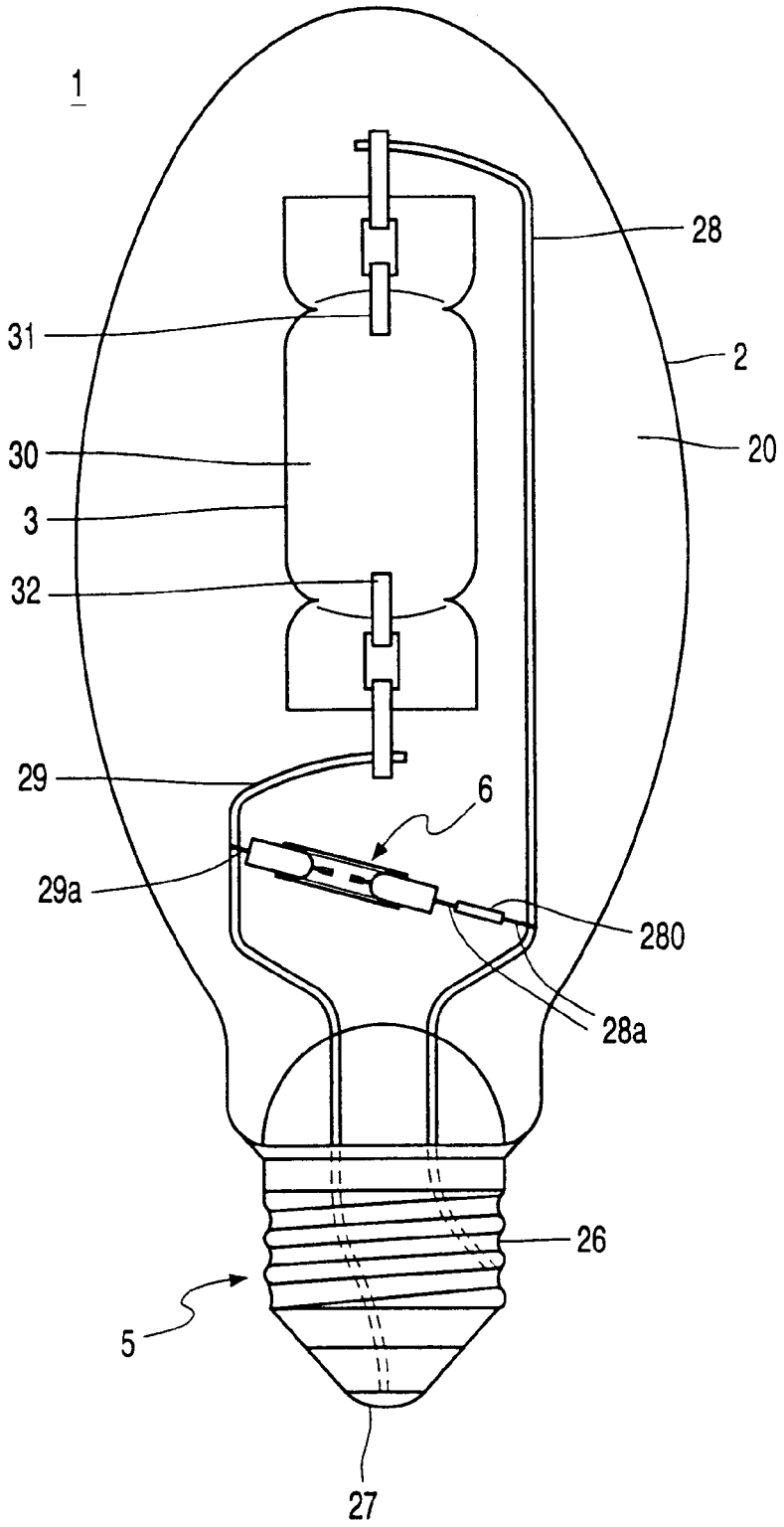
FIG. 3 is an elevation of a modification of a lamp according to the invention.

FIG. 3 shows a modification of the lamp according to the invention in elevation, which lamp is suitable for being ignited and operated on an installation provided with an ignition circuit which supplies a voltage pulse of at most 700 V. Parts corresponding to those of the lamp of FIG. 1 have been given the same reference numerals. In a practical realization of the lamp, it has a rated power of 400 W and is suitable for operation on a supply source of 220 V, 50 Hz. A suitable ignition circuit for igniting the lamp is, for example, a type SI 51, make Philips, which supplies an ignition voltage pulse of at least 600 V and at most 750 V. The lamp has an ignition voltage of at most 600 V. The lamp filling comprises 77 mg Hg, 16 mg iodide salts with the following percentages by weight: 84.8% NaI, 11.6% TlI, 2.8% InI, and 8.8% $InI_3$, and argon with a filling pressure of 2700 Pa. The UVE, which has an internal diameter of 3 mm and an electrode spacing of 3 mm, has an ignition voltage of 166 V. Upon lamp ignition, ignition delays far below 30 ms occur. Even if the ignition circuit has been switched off, an ignition delay of at most 30 ms occurs in the UVE and of at most 40 ms in the lamp.

What is claimed is:

1. A metal halide lamp provided with a discharge vessel which encloses a discharge space and which is surrounded with intervening space by an outer bulb which is fitted with a lamp cap, in which intervening space a UV enhancer (UVE) with a ceramic wall is accommodated, wherein the UVE is provided with two internal electrodes between which a glow discharge can extend.

2. A lamp as claimed in claim 1, wherein one of the two internal electrodes is provided with an electrode winding.

3. A lamp as claimed in claim 1 wherein one of the internal electrodes is provided with an emitter.

4. A lamp as claimed in claim 1, wherein each of the electrodes of the UVE is provided with an electrode winding with emitter.

* * * * *